US005161699A

United States Patent [19]

Hanna et al.

[11] Patent Number: 5,161,699

[45] Date of Patent: Nov. 10, 1992

[54] DISPLAY STAND HAVING STAIR-LIKE MULTIPLE BOX STRUCTURE

[75] Inventors: James Hanna, Athens; David C. F. Stoddard, Atlanta; Ladd M. Orr, Clarkston, all of Ga.; Jeffrey J. Jarmuz, Colgate; Donald R. Jones, Mequon; Joseph P. Schomisch, New Berlin, all of Wis.

[73] Assignee: The Mead Corporation, Dayton, Ohio

[21] Appl. No.: 868,053

[22] Filed: Apr. 13, 1992

[51] Int. Cl.[5] ..... A47F 5/00

[52] U.S. Cl. ..... 211/132; 211/72; 211/194; 248/174

[58] Field of Search ..... 211/72, 130, 128, 132, 211/194, 55; 248/174

[56] References Cited

U.S. PATENT DOCUMENTS

| | | | |
|---|---|---|---|
| 1,035,552 | 8/1912 | Doering | 211/132 X |
| 1,911,368 | 5/1933 | Kress . | |
| 2,940,710 | 6/1960 | Adams | 248/174 |
| 3,438,508 | 4/1969 | Kuns et al. | 211/133 |
| 4,162,014 | 7/1979 | Bobvick | 211/55 X |
| 4,411,382 | 10/1983 | Taub | 248/174 X |
| 4,574,960 | 3/1986 | Shikatani | 211/194 X |
| 4,708,240 | 11/1987 | McMahon et al. | 206/45.18 |
| 4,726,476 | 2/1988 | Smith | 211/132 |
| 4,991,804 | 2/1991 | Iannucci | 211/132 X |
| 5,042,651 | 8/1991 | Davis et al. | 211/128 X |

*Primary Examiner*—Robert W. Gibson, Jr.
*Attorney, Agent, or Firm*—Tsugihiko Suzuki

[57] ABSTRACT

A collapsible display stand which comprises a plurality of boxes and a base structure. Each box has an end wall, top and bottom walls, and a pair of side walls. These walls of each box define an internal space for accommodating products. The end wall of each box closes a first end of the box. Each box has a second end opposite the first end. The boxes are fixedly stacked one on top of another to form a stair structure wherein each box is secured at its botttom wall near the first end thereof to the top wall of the lower adjacent box near the second end of the lower adjacent box. Each box has at least one opening for permitting access to its internal space. The base structure is separably engaged with one or more of the boxes, and supports the stair structure in a tilted manner such that the first end of each box is lower than the second end.

11 Claims, 6 Drawing Sheets

DISPLAY STAND HAVING STAIR-LIKE MULTIPLE BOX STRUCTURE

BACKGROUND OF THE INVENTION

The present invention relates to a collapsible display stand for use in merchandising products, and more particularly to a collapsible display stand having a multiple box structure wherein a plurality of display boxes are fixedly stacked one on top of another in a stair-like fashion. The stair-like multiple box structure can be set up easily from a flat collapsed condition and is supported in a tilted manner to form a clearly visible display which utilizes floor space effectively to provide a maximum display area.

Many types of display stands are commercially used to merchandise products. Some of these display stands are made of articulated panel material, such as corrugated cardboard, and are frequently shipped in a collapsed condition to retail stores where they are assembled to form erected display stands.

One such display stand is disclosed in U.S. Pat. No. 4,726,476 wherein a collapsible base structure is hingedly connected to a display tray. During shipment and transportation, the base structure alone is folded flat underneath the display tray while the tray itself is used in a square set up condition as a shipping container. At a display site, the display stand is set up by lifting the tray followed by unfolding the base structure. The fully assembled display stand has a rather plain appearance with the single display tray although the tray is supported in a tilted manner on top of the erected base.

A display stand having plural display trays with a collapsible base structure is disclosed in U.S. Pat. No. 3,438,508. The trays of this display stand are arranged upon full assembly in a stair-like fashion. However, the trays during shipment are again used in a set up condition as shipping containers; the trays are not designed to be folded flat for compact storage. In addition, because the trays in display condition are arranged on a lower front to upper rear basis and each tray is tilted toward its rear side, more floor space may be required to install this display stand as the number of trays increases.

What is needed, therefore, is a collapsible display stand for merchandising products. Such a display stand should be of an attention attracting appearance, and have high product capacity while minimizing floor space requirements. Also, such a display stand should have a collapsible displaying portion for accommodating products which is easy to fold into a flat condition for shipment and storage as well as to assemble into a set-up condition for display.

SUMMARY OF THE INVENTION

The present invention provides a collapsible display stand for merchandising products. The display stand according to the present invention has a stair structure which consists of a plurality of collapsible display boxes for accommodating products. In the stair structure, the boxes are stacked and fixed one on top of another in a stair-like fashion without spoiling their collapsible nature. Such a structure as a whole can be folded flat easily for economical shipment and compact storage. At a display site, the stair structure is assembled from a flat collapsed condition and is supported in a tilted manner by a base structure to provide an attention-attracting display. The base structure may also be of a collapsible construction.

According to the present invention, the manner in which the stair structure is tilted is important to provide a clearly visible display which can effectively utilize floor space.

In the present invention, the stair structure is tilted such that each "stair step" of the stair structure, i.e., the top wall of each box, is inclined toward the lower adjacent stair step. This structure is tilted in such a manner to allow the display stand to occupy minimal floor space, especially when the stair structure is tilted such that the display boxes are disposed in a substantially vertical row. When the boxes are disposed in such a row, a small floor space which could otherwise be substantially filled by a single box can accommodate an entire display stand having boxes of any desired number.

The tilted stair structure can also provide a visible display when cooperating with properly located openings for exposing products. In a preferred embodiment of the present invention, an opening is formed in the tilted top wall of each box of the tilted stair structure. Through these openings, a clear view of and easy access to products in the boxes can be provided. An end wall of each box which faces upwards as a result of tilt of the stair structure may alternately or additionally be provided with an opening. When each box is provided at both the top and end walls with openings, customers can access products in the box from the opposite sides of the display stand.

In one embodiment of the present invention, a partition flap is struck from the top wall of each box to divide the internal space of the box into two sections. Both the sections may be used for the purpose of displaying products. Alternately, one of the sections may be used as a small storage compartment where supplemental products are stored.

In another embodiment, each box includes top and bottom walls and side walls which are foldably joined together to form the tubular structure. An end wall is foldably joined to one of the ends (the lower end) of the tubular structure. When the end wall is releasably locked in a position where it closes the lower end, it holds the associated box in a set-up condition. A partition flap which extends between the side walls may be provided to assist in holding the box in a set-up condition.

A manifestation of the present invention, therefore, is a collapsible display stand which comprises a plurality of boxes and a base structure. Each box has first and second opposite ends and includes top and bottom walls, a pair of side walls and an end wall. These walls of each box are defined by crease lines and define an internal space for accommodating products in it. The end wall of each box closes the first end of the corresponding box. The boxes are fixedly stacked one on top of another in a stair fashion such that each box is secured at its bottom wall near the first end thereof to the top wall of the lower adjacent box near the second end of the lower adjacent box. Each box has at least one opening for permitting access to its internal space. The base structure is separably engaged with one or more of the boxes, and supports the stacked boxes in a tilted manner such that the altitude of each box is lower at the first end than at the second end.

Accordingly, it is an object of the present invention to provide a collapsible multiple box display stand wherein display boxes are arranged in an attention-attracting fashion; to provide such a display stand wherein a stair-like multiple box structure can be folded flat; to provide such a display stand which is easy to assemble; to provide such a display stand which can utilize floor space effectively to provide a maximum display area; and to provide such a display stand which can provide a clearly visible display.

DETAILED DESCRIPTION OF THE INVENTION

Figure 2:
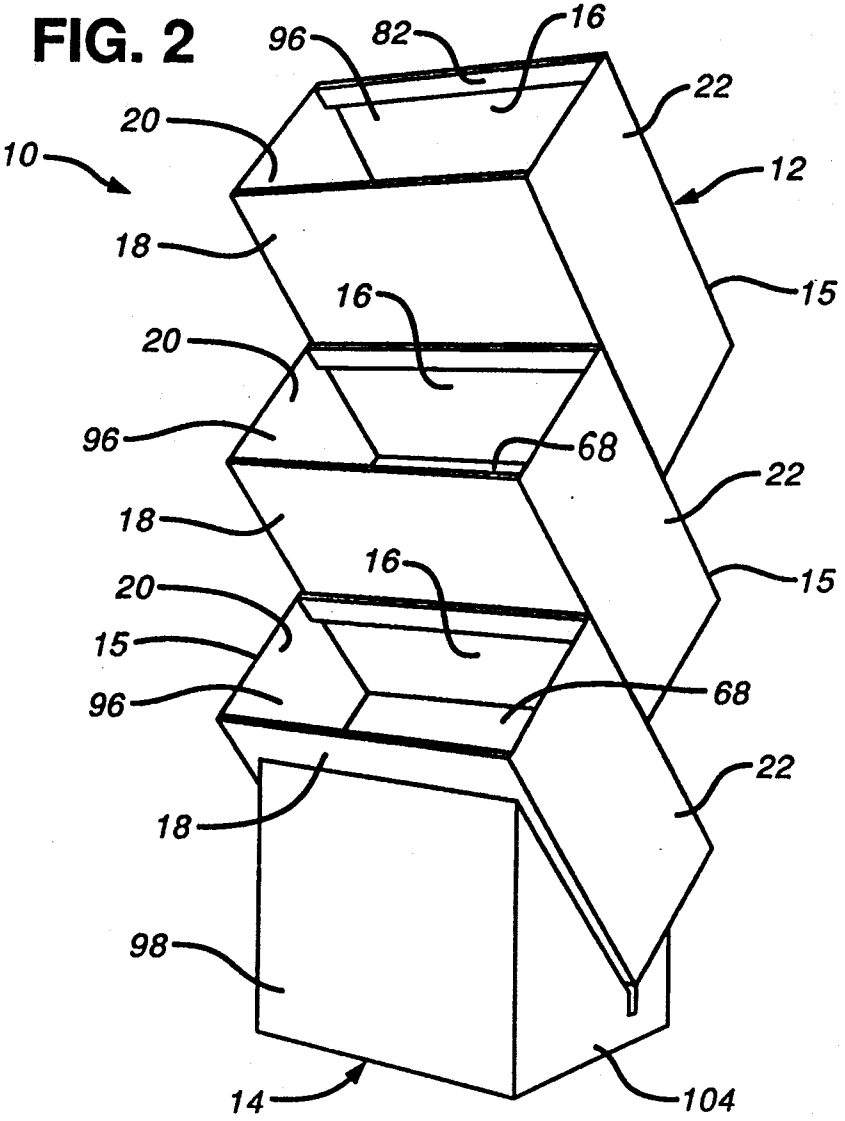
FIG. 2 is a perspective view of the display stand in FIG. 1, illustrating the stand in a different angle.
Figure 1:
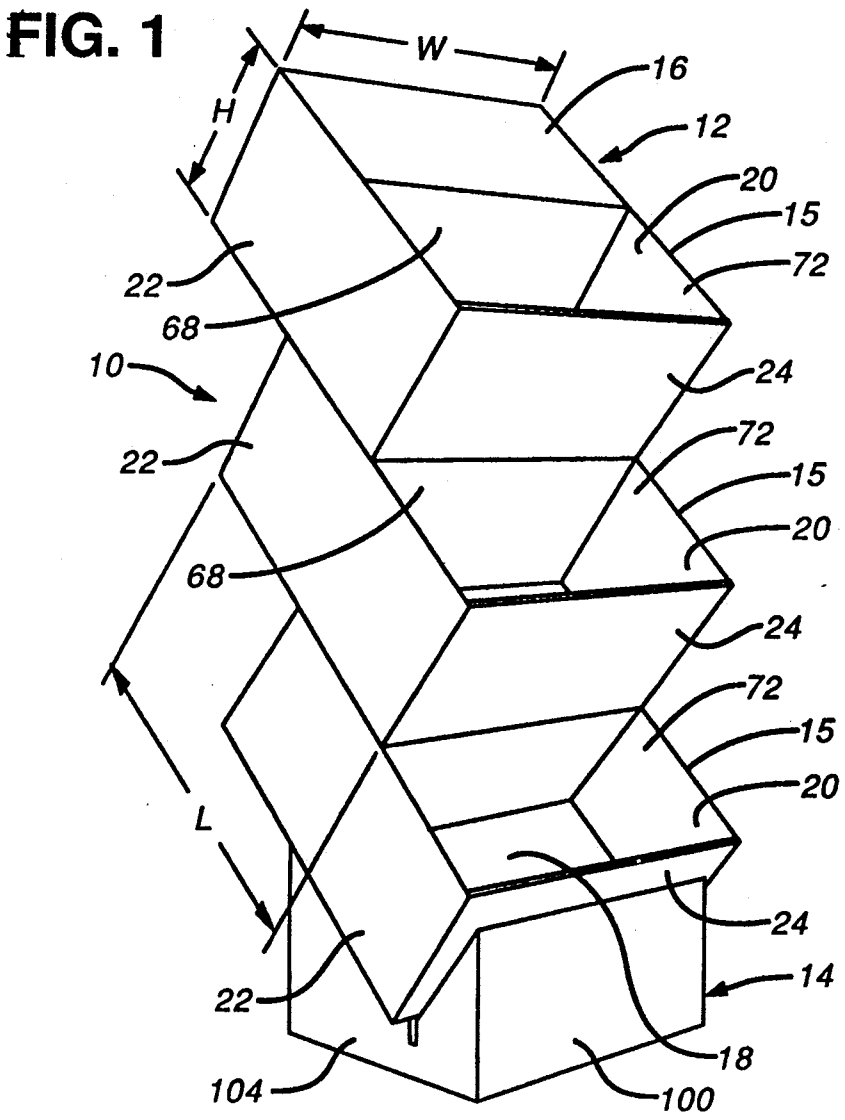
FIG. 1 is a perspective view of a display stand in accordance with the present invention.
Figure 3:
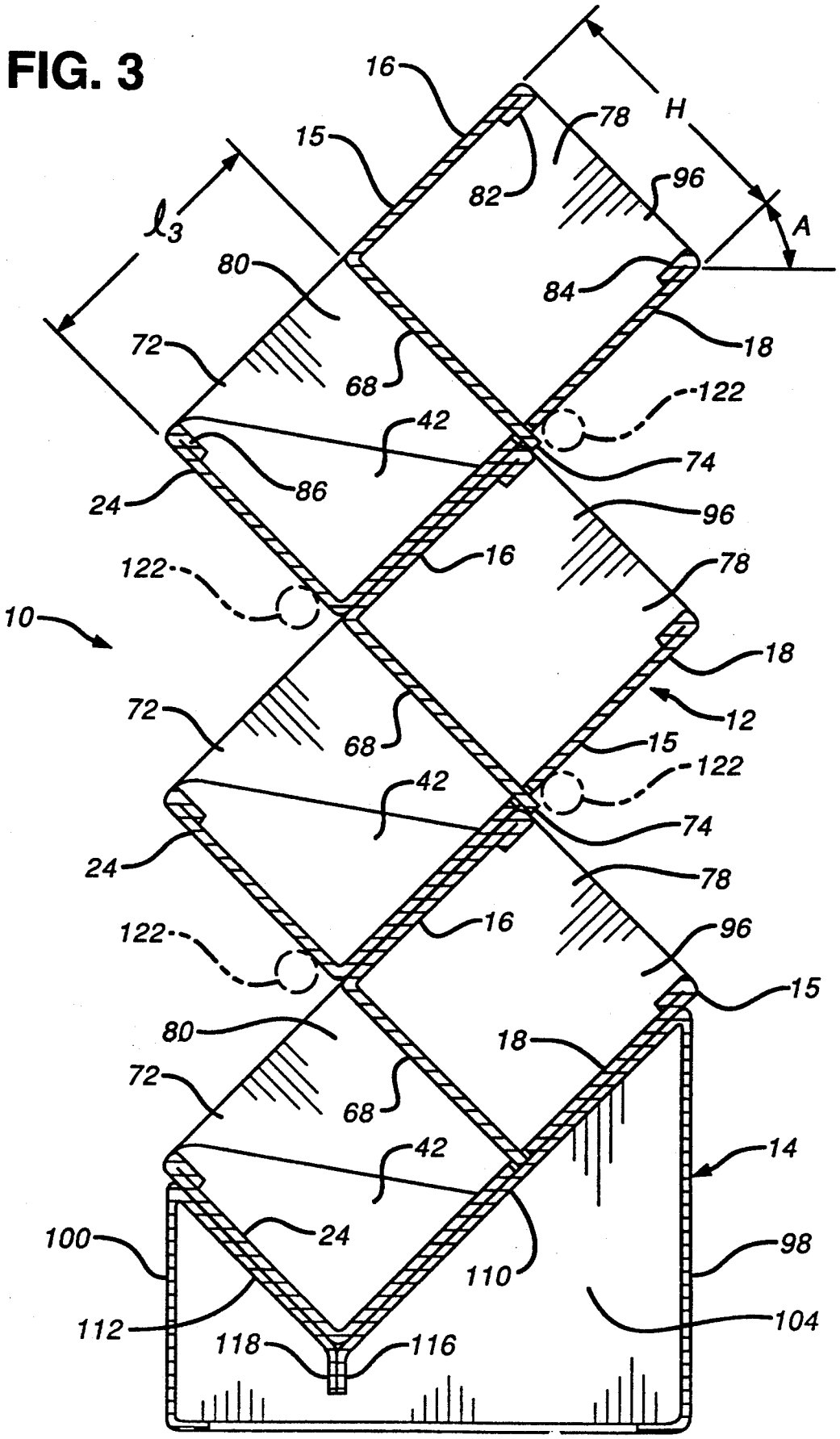
FIG. 3 is a vertical sectional view of the display stand in FIG. 1.

Referring now to the drawings, FIGS. 1 to 8 illustrate one preferred embodiment of the present invention. FIGS. 1 to 3 show a display stand, generally designated 10, for displaying packaged products, particularly packaged food products such as potato chips, tortilla chips and the like. The display stand 10 comprises two main elements, i.e., a stair structure 12 and a base structure 14. The stair structure 12 consists of a plurality of substantially rectangular display boxes 15 for accommodating products to be displayed; the boxes 15 are fixedly stacked one on top of another in a stair-like fashion to form the stair structure 12. The base structure 14 is designed to separably engage the bottom of the stair structure 12 so as to support the stair structure 12 in a tilted manner. The display stand 10 in FIGS. 1-3 is shown with three boxes 15 of the same size and shape. However, more or less than three boxes may be employed so long as they provide a display stand of usable height, and boxes of different sizes and shapes may be used in the present invention. The base structure 14 may also be of a different structure as will be described later in more detail.

Each of the base structure 14 and the boxes 15 is preferably formed of paperboard material such as cardboard, fiberboard, corrugated cardboard, corrugated fiberboard or the like; however, it may be formed of any other panel/board material having certain stiffness and certain fatigue strength against repeated folding stress. Such material may be plastic panel, corrugated plastic board, paper-plastic laminated panel, and plastic composite material.

Figure 4:
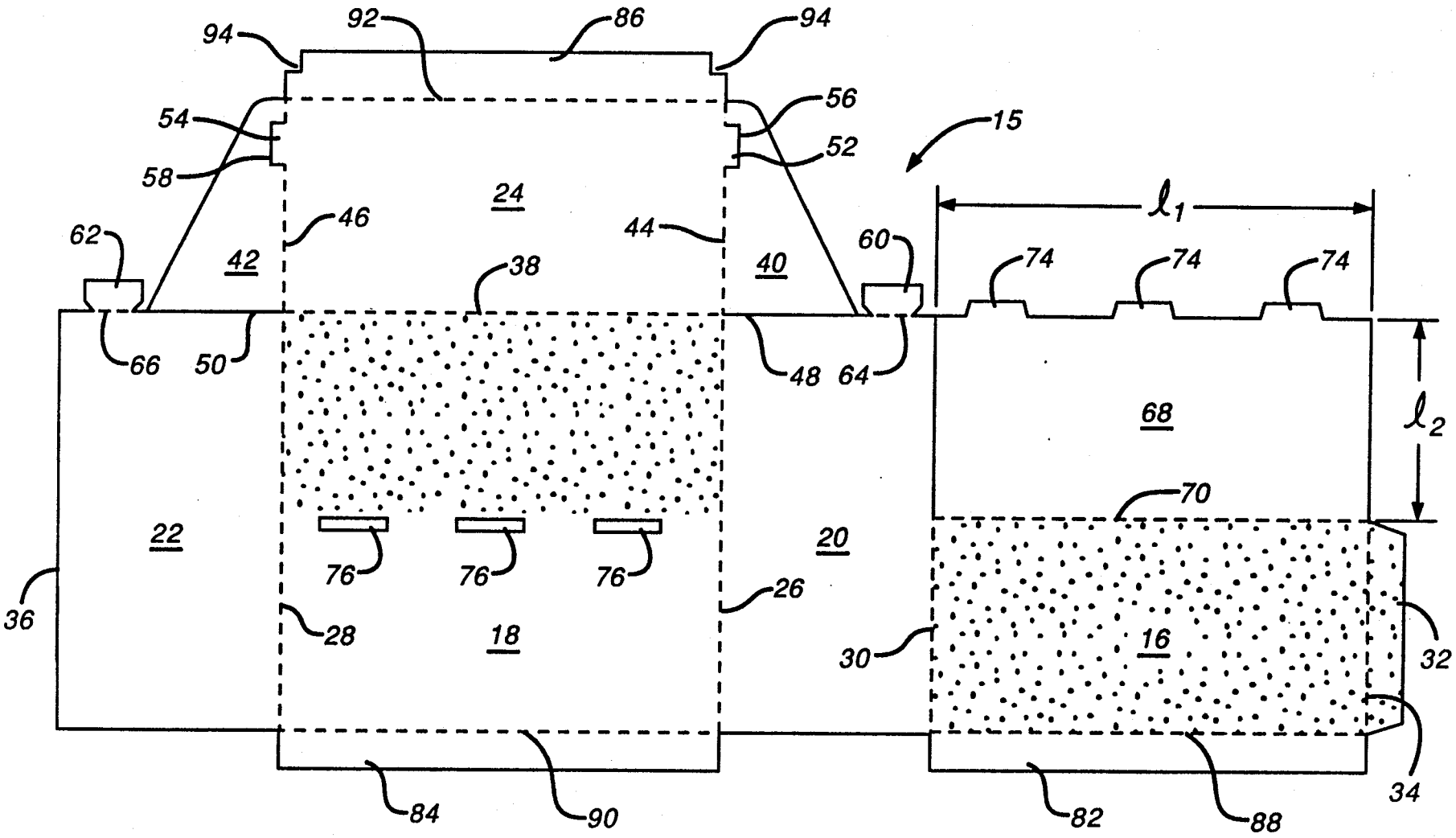
FIG. 4 is a plan view of a box in blank form.

A discrete box 15 is illustrated in blank form in FIG. 4, wherein side walls 20 and 22 are foldably joined to a bottom wall 18 respectively along fold lines 26 and 28, and a top wall 16 is foldably joined to the side wall 20 along a fold line 30. A glue flap 32 is foldably joined to the top wall 16 along a fold line 34. This flap 32 is used to interconnect the top wall 16 with the free edge 36 of the side wall 22 so that the walls 16, 18, 20 and 22 constitute a tubular portion of the box 15 when the box is assembled.

As also illustrated in FIG. 4, an end wall 24 is foldably joined to the bottom wall 18 along a fold line 38 to close, upon folding thereof, the adjacent one of the opposite ends of the tubular portion. Alternately, the end wall 24 may be joined to any of the other walls 16, 20 and 22 if so desired. The end wall 24 is provided with a pair of essentially triangular side flaps 40 and 42 foldably joined thereto along interrupted fold lines 44 and 46. These flaps 40 and 42, when the box is set up, are folded inwardly of the box 15 along the fold lines 44 and 46 and rest at the lower edges 48 and 50 thereof on the bottom wall 18. The lower edges 48 and 50 of the flaps 40 and 42 extend at right angle with respect to the fold lines 44 and 46 to assist in holding the end wall 24 perpendicular to the bottom wall 18 when the end wall 24 is in the closed position. Tongues 52 and 54 are struck respectively from the flaps 40 and 42 to define slots 56 and 58 near the interrupted portions of the fold lines 44 and 46. These slots 56 and 58 are used to receive and engage tabs 60 and 62 which are foldably connected to the end edges of the side walls 20 and 22 along fold lines 64 and 66. These tabs 60 and 62, when received in the slots 56 and 58, lock the end wall 24 in the closed position. The end wall 24 locked in the closed position holds the tubular portion of the box 15 in a squared, set-up condition against crushing force acting to collapse the tubular portion. The tongues 52 and 54 serve as means for guiding the tabs 60 and 62 into the slots 56 and 58.

As further illustrated in FIG. 4, a partition flap 68 is struck from the top wall 16. This flap 68, when the box is set up, is folded inwardly of the box about a fold line 70 and provides in the top wall 16 an opening 72 (see FIGS. 1-3) for permitting access to products in the box 15. The partition flap 68 may be of any size and shape so long as it defines an opening appropriate to expose products. In FIG. 4, however, about a half of the top wall 16 is used as the partition 68 to form the relatively large opening 72 which can contribute to clearly visible display as well as to provide a structural support for holding the box 15 in a set-up condition. This partition flap 68 has a transverse length ($l_1$) substantially equal to the width (W) of the box 15, and therefore it serves as a structural support when it extends between the side walls 20 and 22 entirely across the width of the box 15 upon folding thereof. The longitudinal length ($l_2$) of the the flap 68 is approximately equal to the height (H) of the box 15, and thus the flap 68 extends also entirely across the height of the box 15 when folded about 90 degrees into the box 15 (see FIG. 3). Locking tabs 74 are disposed at intervals along the free end edge of the flap 68 to enter slots 76 formed in the bottom wall 18 intermediately between the opposite end edges 38 and 90. Engagement between the tabs 74 and the slots 76 allows the flap 68 to be locked in the folded position where it divides the internal space of the box into two sections 78 and 80 (see FIG. 3).

Hem flaps 82, 84 and 86 are provided along the respective free edges of top, bottom and end walls 16, 18 and 24. These flaps 82, 84 and 86, when the box is set up, are folded along fold lines 88, 90 and 92 into face-to-face contact with the inner surfaces of the walls 16, 18 and 24 to reinforce the respective free edges. The flaps 82, 84 and 86, after folded, may be attached respectively to the inner surfaces of the walls 16, 18 and 24 by means of adhesive, staples or the like. Cutouts 94 are provided at the outer corners of the hem flap 86 to prevent the flap 86 from interfering with the tabs 60 and 62.

In view of the forgoing description, it will be apparent that each box 15 in an assembled condition has a tubular structure with one of the opposite ends closed by the end wall 24; that the internal space of the box is divided by the flap 68 into the two sections 78 and 80; that such a box 15 can be folded flat in a collapsed condition when the end wall 24 and the partition flap 68 are unlocked; and that the top wall 16 is provided at the portion near the closed end with the opening 72 to the internal section 80 whereas the other end of the box 15 is kept open to provide an opening 96 to the internal section 78 (see FIGS. 2 and 3). Both the internal sections 78 and 80 may be used as display compartments where products are placed for display. Alternately, one of the sections 78 and 80 may be used as a storage compartment where supplemental products are temporarily stored. The two openings 72 and 96 formed on each box 15 enable customers to get access to products in the boxes 15 from the opposite sides of the display stand 10, i.e., one side which is shown with the openings 72 in FIG. 1 and the other side which is shown with the openings 96 in FIG. 2. Although it is preferred that each box is provided with the two openings 72 and 96 and the partition 68, either the opening 72 or the opening 96 may be omitted. More particularly, the opening 96 may be closed using another end wall, otherwise the opening 72 together with the partition 68 may be omitted. Other openings may also be provided, for example, in the side walls 20 and 22.

Returning to FIGS. 1-3, the boxes 15 are fixedly stacked together to form the stair structure 12 wherein each box 15 is secured at its bottom wall 18 near its closed end to the top wall 16 of the lower adjacent box 15 near the open end of the lower adjacent box 15. More specifically, each box 15 is overlapped at the area of the bottom wall 18 between the fold line 38 and the slots 76 with the area of the top wall 16 of the lower adjacent box 15 between the fold lines 70 and 88 (see the shaded areas in FIG. 4), and the overlapped areas are secured together. An adhesive may preferably be used to secure the boxes 15 together; however, any mechanical locks such as staples, tab-and-slot engagement or the like may also be used.

The above-described manner of joining the boxes 15, i.e., the illustrated stair-like arrangement of the boxes 15, allows the opening 72 of each box 15 to be fully exposed without being covered by the upper adjacent box 15 and prevents the locking tabs 74 of each box 15 from interfering with the top wall 16 of the lower adjacent box 15. Apart from these, the aforementioned box arrangement permits each box 15 to maintain its collapsible nature which, in turn, allows the entire stair structure 12 to be collapsible.

Figure 5:
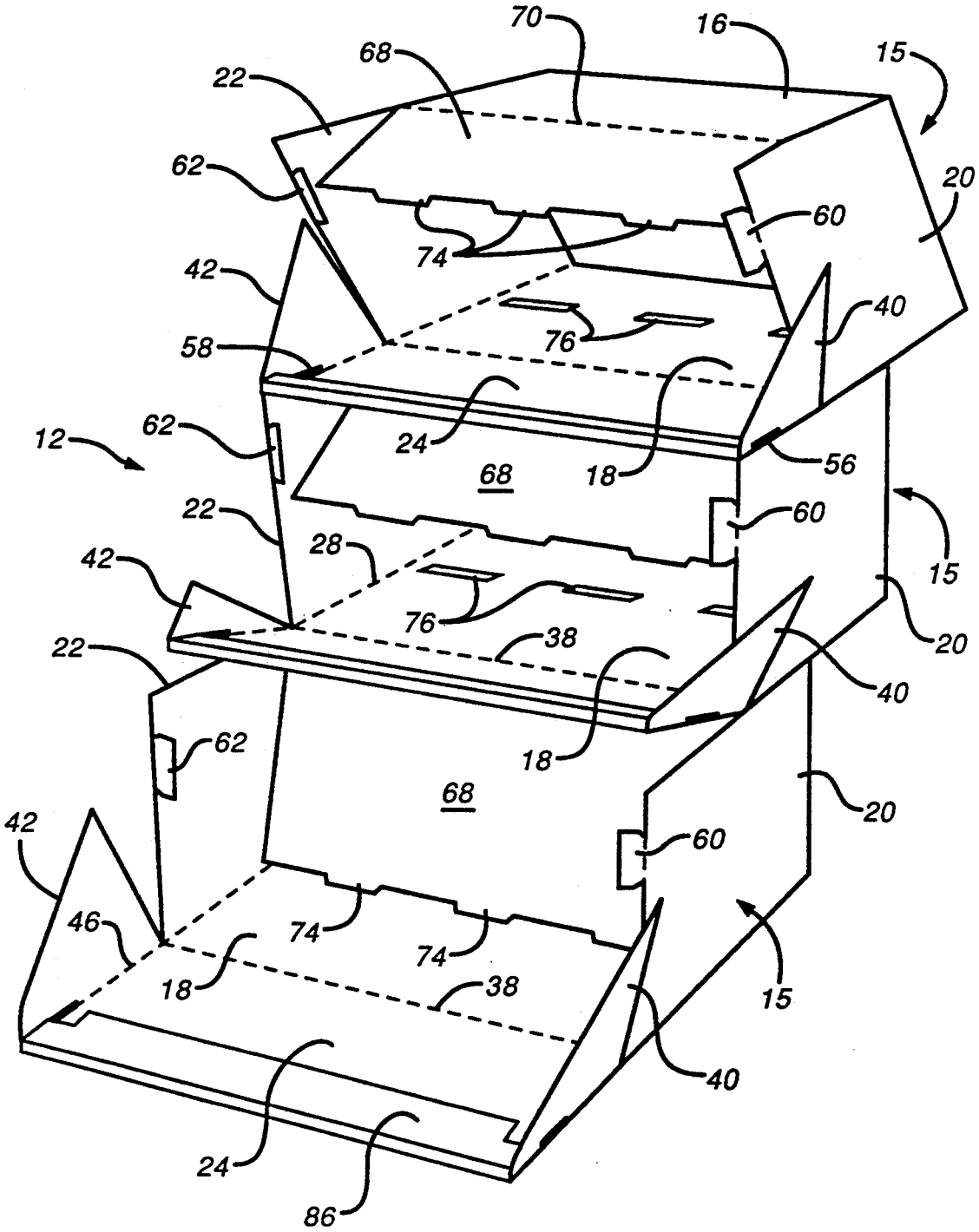
FIG. 5 is a perspective view of a stair structure in a half collapsed condition.
Figure 6:
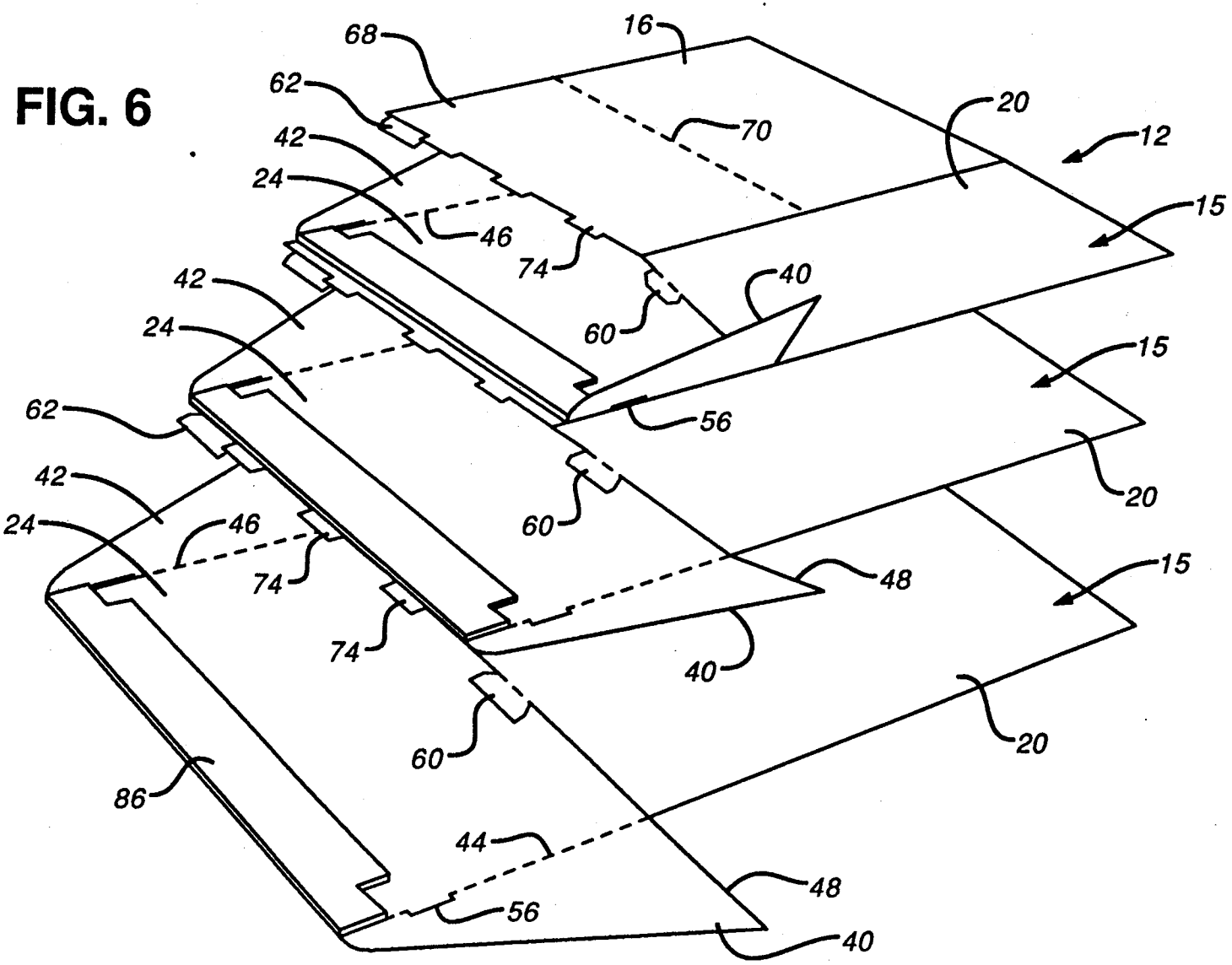
FIG. 6 is a perspective view of the stair structure in a fully collapsed condition.

FIGS. 5 and 6 illustrates how the stair structure 12 is folded flat. First, the tabs 60 and 62 are pulled out of the slots 56 and 58 to unlock the end walls 24, and each end wall 24 is pivoted outwardly of the associated box 15 down to a position over the lower adjacent opening 72 as shown in Fig. 5. The tabs 74 are then disengaged from the slots 76 as also shown in FIG. 5, and the partition flaps 68 are lifted to positions where they generally close the openings 72, respectively. After that, the side walls 20 and 22 of each box 15 are folded in the same direction down to positions where one of the side walls is substantially flush with the associated bottom wall 18 and the other is in face-to-face contact with the bottom wall 18. This folding action results in the stair structure 12 in a flat collapsed condition as shown in FIG. 6 where the top wall 16 of each box 15 together with the associated partition flap 68 is in face-to-face contact with the associated bottom wall 18. In FIG. 6, all the side walls are folded in the same direction; however, the side walls of adjacent boxes may be folded in the opposite directions to provide a more compact collapsed form. The stair structure 12 can be reassembled easily by reversing the above-mentioned process.

Returning again to FIGS. 1-3, the stair structure 12 rests on the base structure 14 and is supported in a tilted manner such that the altitude of each box 15 is lower at its closed end than at its open end. To have the stair structure 12 tilted in this manner is a very important in terms of effective utilization of floor space. As shown FIG. 3, because the stair structure 12 is tilted such that each box 15 is inclined to its closed end, the stair structure 12 requires smaller floor space than it would require if it were tilted such that each box 15 is inclined to its open end. In a preferred embodiment, the stair structure 12 is tilted such that all the boxes 15 are disposed in a substantially vertical row as shown in FIG. 3 wherein the stair structure 12 requires minimum floor space over which it is disposed. For example, where the length (L) of the boxes 15 is about twice as great as the height (H) of the boxes 15 and the length ($l_3$) of the overlapped areas is approximately equal to the height (H) of the boxes 15, the angle (A) at which the stair structure 12 is tilted to assure minimum floor space may be about 45 degrees with respect to a horizontal plane. In such a case, the stair structure 12 can be disposed over a small floor space which can be occupied by one of the boxes 15.

Visibility of product particularly in the lower boxes 15 can also be increased by the fact that the stair structure 12 is tilted in the above described manner and that the openings 72 and 96 are provided at the top wall 16 and the upper end of each box 15, i.e., the portions facing upward as well as sideward.

The stair structure 12 can be designed such that it maintains good stability when it is tilted. In a preferred embodiment, the boxes 15 are of the same size and shape and the lengths ($l_3$) of the secured areas are generally equal. In this case, it is relatively easy to tilt the stair structure 12 such that the stair structure 12 is well balanced on the lowermost box 15. For example, where the length (L) of the boxes 15 is about twice as great as the height (H) of the boxes 15 and where the length ($l_3$) of the overlapped areas is approximately equal to the height (H), the stair structure 12 may be tilted about 45 degrees to have the respective centers of gravity of the boxes 15 disposed substantially along a vertical line.

Although it is preferred to use the boxes 15 of the same size and shape which are secured together with the overlapped areas of a constant length, boxes of different sizes and shapes with overlapped areas of different lengths may be used in the present invention so long as they permit formation of a collapsible stair structure.

The base structure 14, as illustrated in FIGS. 1-3, is of the type which separably engages only with the lowermost box 15. In other words, this base structure 14 is designed to stably support the stair structure 12 which is simply placed thereon, in a tilted position where the stair structure 12 requires minimum floor space.

Figure 7:
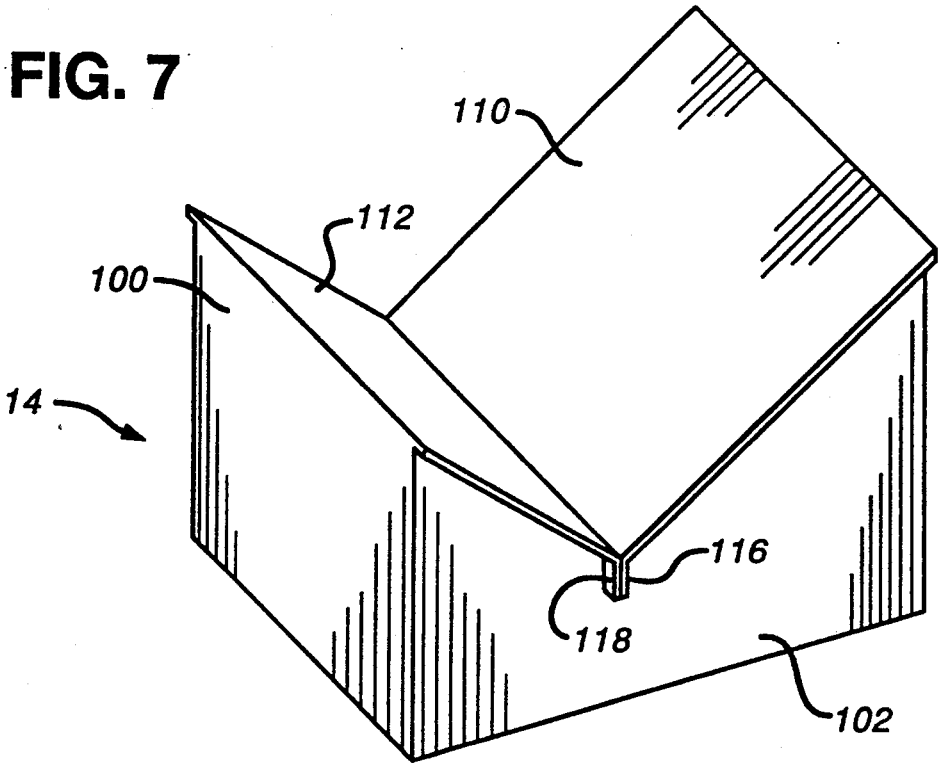
FIG. 7 is a perspective view of a base structure in FIG. 1.
Figure 8:
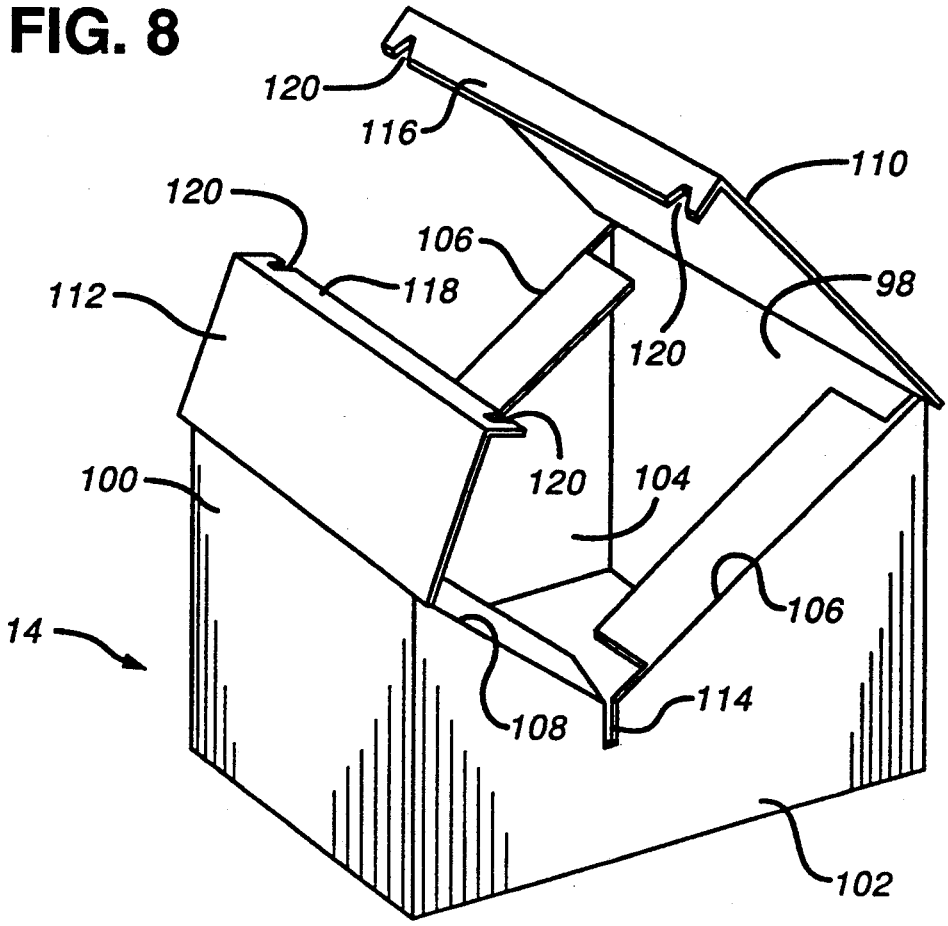
FIG. 8 is a perspective view of the base structure in a partly disassembled condition.

Such a base structure 14 in separated form is shown in FIGS. 7 and 8 wherein the base structure 14 comprises spaced parallel taller and shorter end panels 98 and 100 which are interconnected by a pair of spaced parallel side panels 102 and 104 extending perpendicularly thereto. The side panels 102 and 104 are foldably joined at their longer vertical edges to the side edges of the taller panel 98 and are also foldably joined at their shorter vertical edges to the side edges of the shorter end panel 100. Each side panel has longer and shorter tilted upper edges 106 and 108 which define an essentially V-shaped cutout. Larger and smaller tilted top panels 110 and 112 are foldably joined respectively to the upper edges of the taller and shorter end panels 98 and 100. Upon full assembly of the base structure 14, the top panel 110 rests on and bridges between the upper edges 106 whereas the top panel 112 rests on and bridges between the upper edges 108 whereby formed is a concave support roof on which the lowermost box 15 of the stair structure 12 is positioned.

In the illustrated embodiment, the larger top panel 110 is designed to support the bottom wall 18 of the lowermost box 15 whereas the smaller top panel 112 is designed to abut the end wall 24 of the lowermost box 15 to prevent the stair structure 12 from sliding down along the tilted top panel 110. The angle of the top wall 110, i.e., the angle of the longer edges 106 with respect to a horizontal plane is adjusted to meet a desired angle of inclination of the stair structure 12. The angle defined between the top panels 110 and 112 is adjusted to meet the angle between the bottom and end walls 18 and 24 of the lowermost box 15.

As best illustrated in FIG. 8, a notch 114 is formed in each side panel at the bottom of the associated V-shaped cutout to receive and engage flaps 116 and 118 which are foldably joined to the respective free edges of the top panels 110 and 112. The flaps 116 and 118 are also provided with notches 120 for receiving the side panels 102 and 104 adjacent to the notches 114. By means of these flaps 116 and 118 and notches 114 and 120, the top panels 110 and 112 can be locked in the roof-forming position to hold the base structure 14 in a set-up condition as shown in FIG. 7. On the other hand, once the top panels 110 and 112 are unlocked and lifted, the entire base structure 14 can be folded flat as will be apparent.

Other base structures may alternately be used in the present invention. One of such base structures may be of a larger size than the base structure 14 and may have stepped receiving stations, such as shown in U.S. Pat. No. 3,438,508, for engaging and supporting either the bottom walls 18 or the end walls 24 of the stair structure 14. This base structure is useful in supporting a stair structure tilted to an angular position where the stair structure is difficult to balance on the lowermost box. Another of such base structures may have a post member(s) provided with a plurality of horizontally extending support bars 122 such as shown by the phantom line in FIG. 3. A self-erecting base such as shown in U.S. Pat. No. 4,726,476 may also be used in the present invention.

Having described the invention in detail and by reference to the preferred embodiment thereof, it will be apparent that modification and variation are possible without departing from the scope of the invention defined in the appended claims.

What is claimed is:

1. A collapsible display stand comprising:

a plurality of box members, each having an end wall, top and bottom walls, and a pair of side walls, said walls of each box member defining an internal space for accommodating merchandise therein, said end wall closing a first end of the box member, said box members having a second end opposite the first end, said box members being fixedly stacked one on top of another in a stair-like fashion such that each box member is secured at the bottom wall thereof near the first end thereof to the top wall of a lower adjacent box member near the second end of the lower adjacent box member, each box member having at least one opening for permitting access to said internal space; and a base structure separably engaged with one or more of said box members and supporting said stacked box members in a tilted manner such that the first end of each box member is lower than the second end.

2. The collapsible display stand according to claim 1, wherein said one opening is formed in the top wall of the box member between the first end thereof and the portion where an upper adjacent box member is secured to.

3. The collapsible display stand according to claim 1, wherein the second end of each box member is kept open to serve as said one opening.

4. The collapsible display stand according to claim 2, wherein said one opening is defined by a partition flap struck from the top wall of the box member, said partition flap being foldably joined along a fold line to the top wall and being folded into the box member to divide said internal space into upper and lower sections, said upper section being adjacent to the second end of the box member, said lower section being adjacent to the first end of the box member.

5. The collapsible display stand according to claim 4, wherein each box member has locking means separably engaging said partition flap to releasably lock said partition flap in a folded position where said partition flap partitions said upper section from said lower section.

6. The collapsible display stand according to claim 5, wherein said partition flap defines a free end opposite said fold line and includes a locking tab formed integrally therewith and disposed at said free end, and said locking means is a locking slot formed in the bottom wall of the box member, said locking slot receiving and engaging said locking tab so that said partition flap extends between the top and bottom wall of the box member.

7. The collapsible display stand according to claim 1, wherein the side walls of each box member are foldably joined to the bottom wall and the top wall along a plurality of fold lines, said fold lines of each of said box members being mutually parallel, whereby said box members may be collapsed along said fold lines as a single unit.

8. The collapsible display stand according to claim 7, wherein each box member has locking means separably engaging the end wall thereof to releasably lock the end wall in a closed position where the end wall closes the first end of the box member.

9. The collapsible display stand according to claim 8, wherein the end wall of each box member is foldably joined to the bottom wall and includes a pair of side flaps foldably joined to opposite side edges thereof, said side flaps respectively having locking slots formed therein, and said locking means comprises locking tabs foldably joined respectively to the side walls of the box member and entering and engaging said locking slots to hold the end wall in said closed position.

10. The collapsible display stand according to claim 7, wherein a partition flap is struck from the top wall of the box member, said partition flap being foldably joined to the top wall and being folded into said internal space, said partition flap extending across the width of the box member between the side walls thereof to assist in holding the box member in a squared, set-up condition.

11. The collapsible display stand according to claim 1, wherein said box members are supported in a tilted manner such that said stacked box members are disposed in a substantially vertical row.

* * * * *